US006042767A

United States Patent [19]

Hashemzadeh et al.

[11] Patent Number: 6,042,767

[45] Date of Patent: Mar. 28, 2000

[54] METHOD OF PRODUCING A CELLULOSIC YARN

[75] Inventors: Abdulmajid Hashemzadeh, Burgkirchen; Peter Raidt, Obernburg, both of Germany

[73] Assignee: Akzo Nobel NV, Arnhem, Netherlands

[21] Appl. No.: 09/180,867

[22] PCT Filed: May 27, 1997

[86] PCT No.: PCT/EP97/02742

§ 371 Date: Nov. 24, 1998

§ 102(e) Date: Nov. 24, 1998

[87] PCT Pub. No.: WO97/46745

PCT Pub. Date: Dec. 11, 1997

[30] Foreign Application Priority Data

May 30, 1996 [DE] Germany ..... 196 21 602

[51] Int. Cl.[7] ..... D01D 10/06; D01F 2/02

[52] U.S. Cl. ..... 264/103; 8/125; 264/187; 264/211.14; 264/211.15; 264/233

[58] Field of Search ..... 264/103, 187, 264/203, 211.14, 211.15, 233; 8/125

[56] References Cited

U.S. PATENT DOCUMENTS 5,662,858 9/1997 Firgo et al. ..... 264/187 X

FOREIGN PATENT DOCUMENTS

WO 92/14871 9/1992 WIPO .
WO 95/24524 9/1995 WIPO .
WO 95/28516 10/1995 WIPO .

*Primary Examiner*—Leo B. Tentoni
*Attorney, Agent, or Firm*—Oliff & Berridge, PLC

[57] ABSTRACT

In a process for manufacturing a cellulosic yarn by spinning of a solution of cellulose in a tertiary amine oxide, the solution possibly containing water and/or a stabilizer, to form fibers or filaments, coagulating, washing, and drying, the yarns are treated prior to drying with an aqueous alkaline solution for a period less than 20 seconds.

15 Claims, 1 Drawing Sheet

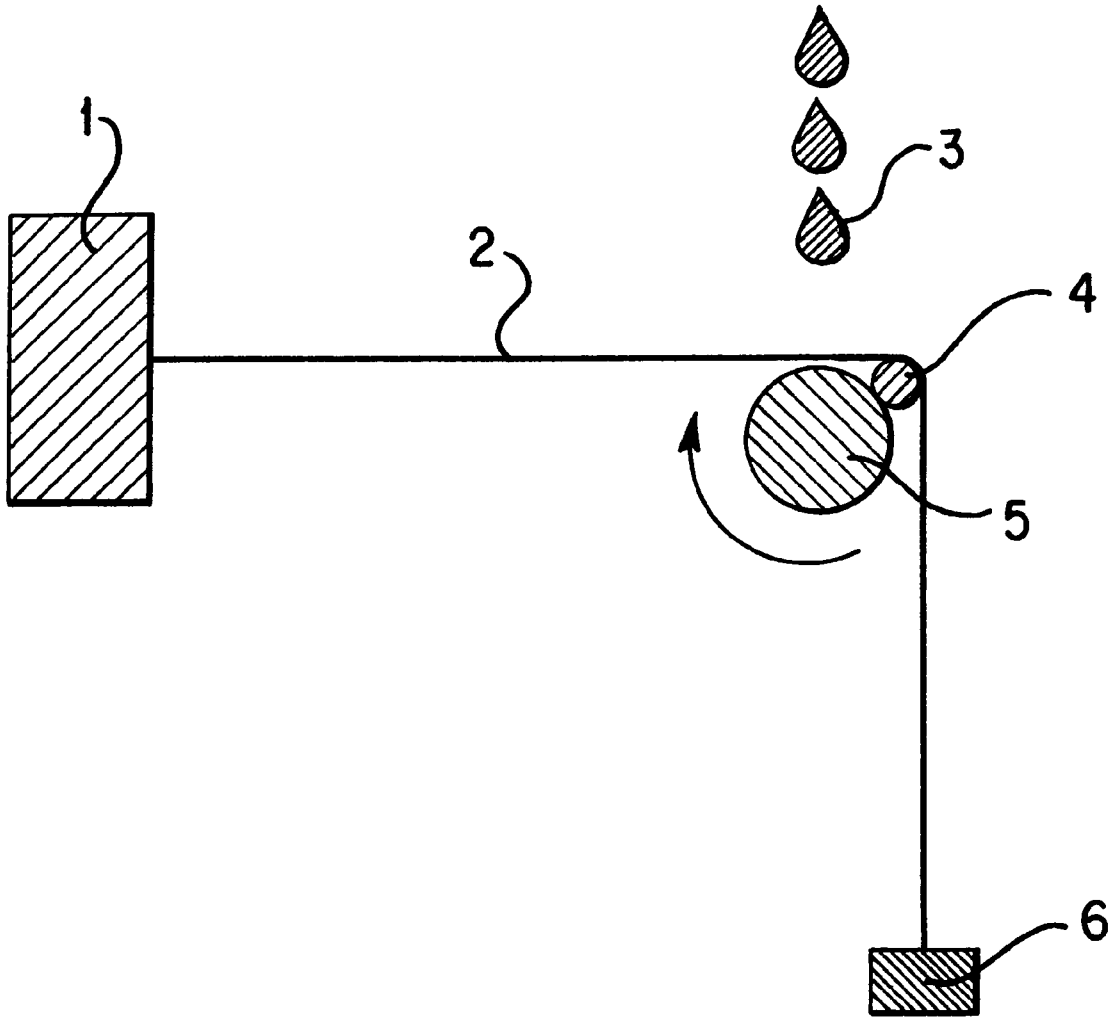
FIG.

METHOD OF PRODUCING A CELLULOSIC YARN

BACKGROUND OF THE INVENTION

1. Field of the Invention

The invention relates to a process for manufacturing a cellulosic yarn by spinning a solution of cellulose in a tertiary amine oxide, the solution possibly containing water and/or a stabilizer, to form fibers or filaments, coagulating, washing, and drying.

2. Discussion of Related Art

W095/24524 discloses a process for improving the color characteristics of woven fabrics made from so-called Lyocell yarns. Lyocell yarns are solvent-spun cellulose yarns manufactured by spinning a solution of cellulose in an organic solvent. The solvent is essentially an aqueous tertiary amine oxide, for example N-methylmorpholine-N-oxide (NMMO). In accordance with W095/24524, woven fabrics made from the cited cellulose yarns are subjected to a mercerizing process, i.e., treated with an alkaline solution. This mercerizing corresponds in principle to that common for cotton woven fabrics, and it is preferred to employ an aqueous NaOH solution with a concentration of 10 to 30% by weight at room temperature or a somewhat higher temperature (for example, up to 35° C.). Subsequently, a washing of the woven fabrics with water can be carried out. To neutralize the lye bath, the fabric is treated with a diluted aqueous acid, washed repeatedly to remove the acid, and then dried. According to the examples in W095/24524, in which aqueous NaOH solutions were employed in concentrations of 14% and 25% by weight, respectively, the treatment of woven fabrics made from Lyocell yarns was carried out at room temperature over a period of 45 seconds. The woven fabrics obtained exhibited a deeper shade after dyeing than non-mercerized fabrics. Although the appearance of the mercerized fabrics was better after 5 washings than that of non-mercerized fabrics, and the yarns of the mercerized fabrics had shorter fibrils than non-mercerized fabrics, it was shown that this mercerizing conducted on the fabrics, i.e. on yarns that had previously been dried, led among other things to a deterioration of the textile properties, especially the strength.

SUMMARY OF THE INVENTION

The invention was therefore based on the objective of providing a process for manufacturing cellulosic yarns by spinning a solution of cellulose in a tertiary amine oxide, the solution possibly containing water and/or a stabilizer, to form fibers or filaments, coagulating, washing, and drying, whereby the aforementioned disadvantages are at least reduced using this process.

This objective is met in the cited process in that the yarns are treated before drying with an aqueous alkaline solution for a period less than 20 seconds.

BRIEF DESCRIPTION OF THE DRAWINGS

The Figure illustrates a wet abrasion testing apparatus used to measure the tendency of cellulosic yarns to form fibrols.

As will be explained in more detail, the process of the invention can on the one hand be employed to reduce effectively the fibrillation of Lyocell yarns. Furthermore, the process is time-saving and cost-effective, since it can be directly integrated into the manufacturing process of the yarns, thus obviating the need for a separate treatment step for the resulting textile fabrics.

Due to the treatment of the yarn with the aqueous alkaline solution, the whiteness level of the yarn increases. This has the advantage that a subsequent bleaching of the yarns is no longer required if they are to be used to produce so-called "white goods" or are to be dyed in very light shades.

Preferably, the treatment with the aqueous alkaline solution is carried out for 1 to 15 seconds, whereby 1 to 10 seconds is especially preferred and 2 to 6 seconds is most preferred. An aqueous NaOH or KOH solution is preferably used. The concentration of alkali in the aqueous alkaline solution should be between 0.5 and 20% by weight, preferably between 10 and 14% by weight. The aqueous alkaline solution can contain additional inorganic or organic auxiliaries, such as in particular emulsifiers, salts, glycerin, or the like. Through the addition of such surface-active substances, the wetting of the yarns and thus of the filaments or fibers with the aqueous alkaline solution is accelerated. Furthermore, the addition of salts such as table salt, or glycerin, reduces damage to the yarn surface by the treatment with the aqueous alkaline solution.

A treatment temperature in the range of 0 to 60° C. has proven favorable, whereby 20 to 60° C., in particular 40 to 60° C., is preferred.

In addition to observing the short treatment time according to the invention, it is essential that the treatment with the aqueous alkaline solution is carried out on yarns that were not previously dried. The treatment therefore preferably is conducted after the yarn is washed. Conducting the treatment with the aqueous alkaline solution prior to washing, i.e., after coagulation, is also possible, but it hampers the recovery of the tertiary amine oxide from the wash water, since the tertiary amine oxide and the alkaline solution enter the wash water during the subsequent washing step.

After treatment with the aqueous alkaline solution, the yarn should be neutralized in an aqueous acidic solution, such as an acetic acid solution, washed again, and then dried.

For the solvent for the cellulose, N-methylmorpholine-N-oxide (NMMO) is preferably used as the tertiary amine oxide, and the cellulose solution can contain gallic acid propyl ester as a stabilizer.

Wide-angle X-ray scattering measurements with a diffractometer made by STOE & CIE GmbH (45 kV; 40 mA, Cu K$\alpha$) and a position-sensitive detector from the same company, whereby the yarns investigated were wound in parallel on small frames and measurement was carried out in transmission, showed that for cellulosic yarns made by spinning an aqueous solution of cellulose in NMMO and not treated with an aqueous alkaline solution, the equatorial reflections of the (1–10) and (020) peaks are superimposed to form an total peak without separately noticeable maxima for the individual crystallographic directions.

A treatment with aqueous alkaline solution of yarns not previously dried (i.e., yarns according to the invention) and of previously dried yarns causes a separation of these peak maxima.

The main reason for this effect is the increase in the crystallite variable $L_{(1-10)}$. This crystal dimension in particular is influenced by a treatment with an aqueous alkaline solution. For yarns not treated with the aqueous alkaline solution, $L_{(1-10)}$ has values in the range of 3 to 4 nm. Treatment of the yarns with an aqueous alkaline solution results in an increase of $L_{(1-10)}$ by 50%.

It was determined that the influence of the treatment with aqueous alkaline solution on the structural parameters observable using wide-angle X-ray scattering is practically the same for yarns in accordance with the invention and for previously dried yarns that are subsequently treated with the aqueous alkaline solution. It is all the more surprising, therefore, that the yarns according to the invention exhibit a lower tendency to form fibrils and show no reduction in strength, compared to dried yarns that are subsequently treated with an aqueous alkaline solution.

Wet Abrasion Testing Apparatus

To measure the tendency of the cellulosic yarns to form fibrils, the wet abrasion testing apparatus represented in schematic form in the figure is used. The wet abrasion testing apparatus essentially consists of the elements 1 to 6, which will now be explained. The yarn 2 is fixed in a PVC block 1. The abrasive stress is generated by guiding the yarn 2 over a rotating glass rod 5 with a diameter of 6 mm, attached to which is a ceramic rod 4 with a diameter of 2.5 mm. The glass rod 5 is arranged at a distance of 80 mm from the PVC block 1. The glass rod 5 together with the ceramic rod 4 rotate at a speed of 25 rpm. The yarn 2, which is made taut by a weight 6 of 3 g, is kept wet by sprinkling it with water 3. The distance of the weight 6 from the glass rod 5 is 60 mm. In the following examples, the wet abrasion test was performed for one and two minutes, respectively. The defined and reproducible formation of fibrils generated by the apparatus described was rated on a scale of 1 to 6 by means of microscopic evaluation of the yarn segment subjected to abrasion.

In order to assess the formation of fibrils generated by abrasion, it has proven advantageous to introduce the terms primary and secondary fibrillation.

Primary fibrillation means that fibrils are only observed on the surface of the fibers.

Secondary fibrillation means that the fibrils are also observed in deeper filament layers. The further the secondary fibrillation progresses, the longer and thicker the fibrils become. Using the terms just defined, a scale of marks from 1 to 6 was defined. On this scale, mark 1 means no fibrillation at all, mark 2 means slight primary fibrillation, mark 3 means pronounced primary fibrillation, mark 4 means slight secondary fibrillation, mark 5 means pronounced secondary fibrillation and mark 6 means damage to the entire fiber surface by primary and secondary fibrillation, as observed in untreated yarns.

For each of the following examples, the wet abrasion test was conducted 5 times and an average mark calculated.

EXAMPLES

In each of the following examples, 50 fibers or filaments were spun from a solution of cellulose in NMMO and water. After passing through an air gap, the fibers or filaments were coagulated in a water bath. The filaments were combined to form a yarn (75 dtex, f 50) and washed. The treatment of the yarns with aqueous alkaline solution was carried out in a bath with NaOH solution. In the following tables, the additional conditions for testing are listed, such as the state of the yarns—dried or undried—concentration C of the alkaline solution in percent by weight, temperature T of the bath in °C., and residence time t in the bath in s. The fibrillation of the samples was tested and evaluated, as previously described. For the determination of fibrillation, wet abrasion tests were conducted for 1 and 2 min. The tables contain in each case the average fibrillation marks of five measurement sequences.

Example 1

In trial 1, a dried yarn not treated with aqueous NaOH was subjected to the wet abrasion test. This yarn showed an average fibrillation mark of 5 after conducting the test for 1 min. and a mark of 6 after conducting the test for 2 min. Previously dried yarns (trials 2 to 6) and previously undried yarns, so-called initially wet yarns (trials 7 to 11), were immersed in a bath with aqueous NaOH and subsequently neutralized in a bath with 60% acetic acid, washed, and dried at room temperature. The trial data is summarized in Table 1.

TABLE 1

| Trial No. | State | C/% by weight | T/°C. | t/s | Mark 1 min. | Mark 2 min. |
|---|---|---|---|---|---|---|
| 1 | dried | untreated | — | — | 5 | 6 |
| 2 | dried | 12.0 | 60 | 2 | 5 | 6 |
| 3 | dried | 12.0 | 60 | 5 | 5 | 6 |
| 4 | dried | 12.0 | 60 | 10 | 4 | 5 |
| 5 | dried | 12.0 | 60 | 30 | 3 | 6 |
| 6 | dried | 12.0 | 60 | 600 | 2 | 4 |
| 7 | undried | 12.0 | 60 | 2 | 3 | 5 |
| 8 | undried | 12.0 | 60 | 5 | 2 | 3 |
| 9 | undried | 12.0 | 60 | 10 | 2 | 3 |
| 10 | undried | 12.0 | 60 | 30 | 2 | 3 |
| 11 | undried | 12.0 | 60 | 600 | 2 | 3 |

The data in Table 1 show that the fibrillation behavior of previously dried yarns immersed in a bath with 12% NaOH solution at a temperature of 60° C. and treatment times of 2 and 5 s, respectively, shows no improvement compared to an untreated yarn (trial 1, Table 1). Initially wet yarns, on the other hand, show under the same conditions a significant reduction in fibrillation at bath residence times as low as 2 s. With previously dried yarns, longer residence times (exceeding about 30 s) also result in an improvement in fibrillation, but not to the extent shown for initially wet yarns with a treatment of the short duration in accordance with the invention.

Example 2

To determine the weight loss of the yarns caused by the solubility of the cellulose in the aqueous alkaline solution as a result of the treatment, dried yarns were treated with NaOH solution and neutralized with acetic acid, washed with water, and dried overnight under vacuum at 65° C. The weight loss of the yarns was determined by weighing before and after the treatment. Since the untreated yarn exhibited a certain level of wetness prior to treatment, it was subjected to the same drying conditions as the untreated yarns. The weight loss of the untreated yarns attributable to loss of moisture was 4.6% by weight. This moisture loss was taken into account in determining the total weight loss of the yarns treated with the NaOH solution. The respective treatment conditions and the weight loss attributable to the treatment with the NaOH solution are summarized in Table 2.

TABLE 2

| Trial No. | C/% by weight | T/°C. | t/s | Weight loss/ % by weight |
|---|---|---|---|---|
| 1 | 7.0 | 22 | 5 | −0.5 |
| 2 | 7.0 | 22 | 10 | −0.9 |
| 3 | 7.0 | 22 | 40 | −3.9 |
| 4 | 7.0 | 22 | 60 | −4.2 |
| 5 | 7.0 | 60 | 5 | −0.4 |
| 6 | 7.0 | 60 | 10 | −1.0 |
| 7 | 7.0 | 60 | 40 | −1.9 |
| 8 | 7.0 | 60 | 60 | −2.4 |

TABLE 2-continued

| Trial No. | C/% by weight | T/°C. | t/s | Weight loss/ % by weight |
|---|---|---|---|---|
| 9 | 9.0 | 22 | 2 | −1.1 |
| 10 | 9.0 | 22 | 5 | −2.5 |
| 11 | 9.0 | 22 | 10 | −3.6 |
| 12 | 9.0 | 22 | 40 | −7.6 |
| 13 | 9.0 | 22 | 60 | −8.6 |
| 14 | 9.0 | 60 | 5 | −1.4 |
| 15 | 9.0 | 60 | 10 | −2.4 |
| 16 | 9.0 | 60 | 40 | −2.7 |
| 17 | 9.0 | 60 | 60 | −2.9 |
| 18 | 11.0 | 22 | 5 | −1.8 |
| 19 | 11.0 | 22 | 10 | −2.8 |
| 20 | 11.0 | 22 | 40 | −4.4 |
| 21 | 11.0 | 22 | 60 | −4.5 |
| 22 | 11.0 | 60 | 5 | −1.2 |
| 23 | 11.0 | 60 | 10 | −2.3 |
| 24 | 11.0 | 60 | 40 | −3.4 |
| 25 | 11.0 | 60 | 60 | −3.5 |
| 26 | 12.0 | 22 | 2 | −0.6 |
| 27 | 12.0 | 22 | 5 | −1.0 |
| 28 | 12.0 | 22 | 10 | −2.0 |
| 29 | 12.0 | 22 | 40 | −2.8 |
| 30 | 12.0 | 22 | 60 | −3.2 |
| 31 | 12.0 | 60 | 5 | −0.4 |
| 32 | 12.0 | 60 | 10 | −1.6 |
| 33 | 12.0 | 60 | 40 | −2.6 |
| 34 | 12.0 | 60 | 60 | −2.6 |

The trials in Table 2 show that the weight loss due to the solubility of the cellulose in the NaOH solution is less at a higher temperature (60° C.) than at a lower temperature (22° C.), and increases with increasing treatment time. The weight loss is also dependent on the NaOH concentration. Of the trials presented in Table 2, the greatest weight loss of −8.6% by weight occurred at a concentration of 9% by weight, a temperature of 22° C., and a treatment time of 60 s (trial 13, Table 2).

Significant weight loss is disadvantageous from an economic standpoint and also impedes to a great extent the recovery of the alkaline solution if the latter is to be recycled to the process after purification. The dissolved cellulose concentrates over time in the aqueous alkaline solution. The separation of dissolved cellulose from the aqueous alkaline solution is difficult per se. A separation of the dissolved cellulose, for example by centrifuging or filtration, however, necessarily involves higher costs and loss of alkaline solution, so that the aim should be to minimize weight losses in order to dissolve as little cellulose as possible in the aqueous alkaline solution.

Furthermore, the weight loss also adversely affects the yarn properties and leads to filament or fiber breaks and lint formation, which in turn negatively influence the workability of the yarns and reduces quality.

Initially wet yarns as well can be expected to undergo a weight loss upon treatment in NaOH solution. It is clear, however, that with the short treatment times of the process according to the invention the weight loss of the yarns is considerably lower than with treatments over 40 to 60 s, while at the same time considerably better fibrillation marks are attained compared to the treatment of dried fibers.

Example 3

A series of undried yarns were immersed in NaOH solution for 10 s, subsequently neutralized with 60% acetic acid, washed with water, and dried at room temperature. The NaOH concentrations, the treatment temperature, and the fibrillation behavior of the treated samples are summarized in Table 3.

TABLE 3

| Trial No. | State | C/% by weight | T/°C. | t/s | Mark 1 min. | Mark 2 min. |
|---|---|---|---|---|---|---|
| 1 | undried | 0.5 | 22 | 10 | 3 | 6 |
| 2 | undried | 0.5 | 60 | 10 | 4 | 6 |
| 3 | undried | 1.0 | 22 | 10 | 3 | 6 |
| 4 | undried | 1.0 | 60 | 10 | 4 | 6 |
| 5 | undried | 3.0 | 22 | 10 | 3 | 6 |
| 6 | undried | 3.0 | 60 | 10 | 2 | 5 |
| 7 | undried | 5.0 | 22 | 10 | 2 | 6 |
| 8 | undried | 5.0 | 60 | 10 | 2 | 5 |
| 9 | undried | 7.0 | 22 | 10 | 2 | 5 |
| 10 | undried | 7.0 | 60 | 10 | 2 | 4 |
| 11 | undried | 10.0 | 22 | 10 | 2 | 4 |
| 12 | undried | 10.0 | 60 | 10 | 2 | 3 |
| 13 | undried | 12.0 | 22 | 10 | 2 | 3 |
| 14 | undried | 12.0 | 60 | 10 | 2 | 3 |
| 15 | undried | 15.0 | 22 | 10 | 2 | 4 |
| 16 | undried | 15.0 | 60 | 10 | 2 | 4 |
| 17 | undried | 20.0 | 22 | 10 | 3 | 5 |
| 18 | undried | 20.0 | 60 | 10 | 2 | 5 |

The trials in Table 3 show that an improvement in fibrillation is achieved on initially wet yarns even at low NaOH concentrations. At a treatment duration of 10 s, however, the best fibrillation marks are attained at concentrations from 10 to about 15% by weight. At a concentration of 20% by weight, the fibrillation mark gets worse, in particular the one resulting from the wet abrasion test over 2 min., so that concentrations ranging from 10 to 14% by weight are preferred within the scope of the present invention.

Example 4

While the yarns in Examples 1 to 3 were immersed in a bath with aqueous NaOH for a certain time and therefore subjected in a tension-free state to treatment with the aqueous alkaline solution, in Example 4 dried yarns (trials 1 to 4) and previously undried yarns (trials 5 to 13) were drawn continuously through a bath with aqueous NaOH. In contrast to Examples 1 to 3, the treatment in Example 4 was not tension-free: rather, the yarn was subject to a tension of 2 to 10 cN.

The tension should not exceed 10 cN, however, since stretching of the yarn could otherwise result and reduce the desired effect of reduced fibrillation.

This treatment method is especially favorable, since it permits the direct integration of the yarn treatment of the invention into the manufacturing process. That is, the yarns after coagulation are continuously drawn in the process through the NaOH bath, with subsequent baths for neutralization and washing, and finally dried and wound up. To conduct comparison trials 1 to 4, yarns were produced using the conventional process, i.e. coagulating, washing, drying, and winding up, and then drawn from the spool through the NaOH bath. For both the initially wet and dried yarns, the residence time in the bath was 4 s. Neutralization was carried out in a bath with 60% acetic acid. Subsequently, the yarns were washed and dried at 180° C. The results of these studies are summarized in Table 4.

TABLE 4

| Trial No. | State | C/% by weight | T/°C. | t/s | Mark 1 min. | Mark 2 min. |
|---|---|---|---|---|---|---|
| 1 | dried | 10.0 | 22 | 4 | 6 | — |
| 2 | dried | 10.0 | 60 | 4 | 6 | — |
| 3 | dried | 12.0 | 22 | 4 | 6 | — |
| 4 | dried | 12.0 | 60 | 4 | 6 | — |
| 5 | undried | 10.0 | 22 | 4 | 2 | 4 |
| 6 | undried | 10.0 | 40 | 4 | 1 | 3 |
| 7 | undried | 10.0 | 60 | 4 | 2 | 3 |
| 8 | undried | 11.0 | 22 | 4 | 2 | 3 |
| 9 | undried | 11.0 | 40 | 4 | 3 | 4 |
| 10 | undried | 11.0 | 60 | 4 | 3 | 4 |
| 11 | undried | 12.0 | 22 | 4 | 3 | 4 |
| 12 | undried | 12.0 | 40 | 4 | 3 | 4 |
| 13 | undried | 12.0 | 60 | 4 | 3 | 4 |

The trials listed in Table 4 document that there is a reduction in fibrillation even when using this continuous process in the treatment of undried yarns in accordance with the invention. With a treatment of previously dried yarns, no improvement was attainable, and a fibrillation mark of 6 was obtained regardless of the concentration and treatment temperature.

Tables 5 and 6 contain textile properties for yarns produced in accordance with the invention (Table 5) and comparison yarns (Table 6). The treatment with the aqueous alkaline solution was conducted continuously, as described in Example 4.

TABLE 5

| Trial No. | C/% by weight | T/°C. | t/s | Elongation % | Strength cN/tex | Modulus 5% cN/tex |
|---|---|---|---|---|---|---|
| 1 | — | 22 | 4 | 8.0 | 35 | 27 |
| 2 | 7.0 | 22 | 4 | 9.0 | 37 | 26 |
| 3 | 7.0 | 60 | 4 | 7.5 | 33 | 26 |
| 4 | 10.0 | 22 | 4 | 7.3 | 34 | 28 |
| 5 | 10.0 | 60 | 4 | 6.7 | 33 | 28 |
| 6 | 12.0 | 22 | 4 | 7.7 | 35 | 27 |
| 7 | 12.0 | 60 | 4 | 7.8 | 36 | 28 |

As a comparison example, trial 1 in Table 5 employs a yarn drawn through a water bath at 22° C. rather than a bath with aqueous NaOH. On the basis of trials 2 to 7, it is clear that the textile properties of the yarns produced in accordance with the invention exhibit no significant changes. In particular, the strength is not reduced by the process of the invention.

TABLE 6

| Trial No. | C/% by weight | T/°C. | t/s | Elongation % | Strength cN/tex | Modulus 5% cN/tex |
|---|---|---|---|---|---|---|
| 1 | — | 22 | 4 | 5.8 | 34 | 31 |
| 2 | 10.0 | 22 | 4 | 5.6 | 30 | 28 |
| 3 | 10.0 | 60 | 4 | 6.3 | 31 | 27 |
| 4 | 12.0 | 22 | 4 | 5.8 | 31 | 28 |
| 5 | 12.0 | 60 | 4 | 5.9 | 29 | 26 |

In comparison example 1 in Table 6, previously dried yarns were fed through a water bath at a temperature of 22° C. On the basis of trials 2 to 5 of Table 6, it is clear that the treatment with aqueous NaOH of dried yarns leads to lower strength values and to a lower modulus at 5% elongation. The yarns produced by the process of the invention (Table 5) are thus distinguished by not only reduced fibrillation but also nearly unchanged textile properties.

What is claimed is:

1. Process for manufacturing a cellulosic yarn by spinning a solution of cellulose in a tertiary amine oxide to form fibers or filaments, coagulating, washing, and drying, wherein prior to drying, the yarns are formed from the fibers or filaments and the yarns are treated with an aqueous alkaline solution for a period less than 20 seconds.

2. Process in accordance with claim 1, wherein the treatment with the aqueous alkaline solution is conducted for a period of 1 to 10 seconds.

3. Process in accordance with claim 1, wherein the aqueous alkaline solution comprises a solution of NaOH or KOH.

4. Process in accordance with claim 1, wherein a concentration of alkali in the aqueous alkaline solution is between 0.5 and 20% by weight.

5. Process in accordance with claim 1, wherein the aqueous alkaline solution further comprises inorganic or organic auxiliaries.

6. Process in accordance with claim 5, wherein the inorganic or organic auxiliaries comprise emulsifers, salts, or glycerine.

7. Process in accordance with claim 1, wherein the treatment with the aqueous alkaline solution is conducted at a temperature of 0 to 60° C.

8. Process in accordance with claim 1, wherein the treatment with the aqueous alkaline solution is carried out after the washing of the yarns.

9. Process in accordance with claim 1, wherein the yarns, after treatment with the aqueous alkaline solution, are neutralized in an aqueous acidic solution, washed, and subsequently dried.

10. Process in accordance with claim 1, wherein the tertiary amine oxide is N-methylmorpholine-N-oxide.

11. Process in accordance with claim 2, wherein the treatment with the aqueous alkaline solution is conducted for a period of 2 to 6 seconds.

12. Process in accordance with claim 4, wherein the concentration of alkali in the aqueous alkaline solution is between 10 and 14% by weight.

13. Process in accordance with claim 7, wherein the treatment with the aqueous alkaline solution is conducted at a temperature of 20 to 60° C.

14. Process in accordance with claim 1, wherein the solution of cellulose in a tertiary amine oxide further contains at least one of water or a stabilizer.

15. Process in accordance with claim 1, wherein the yarns are formed by combining the filaments or fibers following the coagulating of the filaments or fibers, and the yarns are subsequently subjected to the washing, the treatment with the aqueous alkaline solution, and the drying.

* * * * *